US010183820B2

(12) United States Patent
Yoshida et al.

(10) Patent No.: US 10,183,820 B2
(45) Date of Patent: Jan. 22, 2019

(54) SHEET STORAGE APPARATUS AND IMAGE FORMING APPARATUS

(71) Applicant: CANON KABUSHIKI KAISHA, Tokyo (JP)

(72) Inventors: Masatoshi Yoshida, Susono (JP); Akira Matsushima, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/067,671

(22) Filed: Mar. 11, 2016

(65) Prior Publication Data

US 2016/0289017 A1 Oct. 6, 2016

(30) Foreign Application Priority Data

Mar. 31, 2015 (JP) ..... 2015-070665

(51) Int. Cl.
*B65H 1/00* (2006.01)
*B65H 1/26* (2006.01)
*B65H 1/04* (2006.01)

(52) U.S. Cl.
CPC ..... *B65H 1/266* (2013.01); *B65H 1/04* (2013.01); *B65H 2405/11172* (2013.01); *B65H 2405/11425* (2013.01); *B65H 2405/13* (2013.01); *B65H 2511/10* (2013.01); *B65H 2511/212* (2013.01)

(58) Field of Classification Search
CPC ..... B65H 2511/212; B65H 2511/10; B65H 2405/11172; B65H 2405/11425; B65H 2405/13; B65H 2405/212; B65H 2405/214
See application file for complete search history.

(56) References Cited

U.S. PATENT DOCUMENTS 5,921,690 A 7/1999 Shinmachi et al.
6,027,269 A 2/2000 Yoshida
6,643,480 B2 11/2003 Kuwata et al.
6,669,188 B1 * 12/2003 Marasco ..... B65H 1/04 271/145
6,871,848 B2 3/2005 Matsushima et al.
(Continued)

FOREIGN PATENT DOCUMENTS

JP 04-333429 A 11/1992
JP 2002-205829 A 7/2002
(Continued)

OTHER PUBLICATIONS

Japanese Office Action dated Oct. 30, 2018, in related Japanese Patent Application No. 2015-070665.

*Primary Examiner* — Howard J Sanders
(74) *Attorney, Agent, or Firm* — Venable LLP

(57) ABSTRACT

A sheet storage apparatus includes a sheet storage portion and a regulating member configured to regulate positions of a sheet that is stored in the sheet storage portion. The regulating member includes a regulating portion configured to abut against the sheet. The regulating member is moved to a first regulating position on which the regulating portion regulates an end portion in a first direction of a first sheet having a first size. In addition, the regulating member is moved to a second regulating position on which the regulating portion regulates an end portion, in a second direction orthogonal to the first direction, of a second sheet having a second size different from the first size.

20 Claims, 8 Drawing Sheets

(56) References Cited

U.S. PATENT DOCUMENTS

| | | | | |
|---|---|---|---|---|
| 7,533,880 | B2 | 5/2009 | Kawanishi et al. | |
| 7,819,520 | B2 * | 10/2010 | Takagi | B41J 15/042 347/101 |
| 7,971,868 | B2 | 7/2011 | Matsushima et al. | |
| 8,186,671 | B2 | 5/2012 | Nishiyama | |
| 8,302,956 | B2 | 11/2012 | Matsushima et al. | |
| 8,714,543 | B2 | 5/2014 | Matsushima et al. | |
| 8,783,677 | B2 | 7/2014 | Matsushima et al. | |
| 9,256,183 | B2 | 2/2016 | Ohkubo et al. | |
| 2006/0216088 | A1 * | 9/2006 | Tanaka | B65H 7/04 399/377 |
| 2007/0069450 | A1 * | 3/2007 | Kawanishi | B65H 1/266 271/162 |
| 2011/0024970 | A1 | 2/2011 | Uchida et al. | |

FOREIGN PATENT DOCUMENTS

| | | | |
|---|---|---|---|
| JP | 2006-096534 | A | 4/2006 |
| JP | 2007-091365 | A | 4/2007 |
| JP | 2010-083645 | A | 4/2010 |

* cited by examiner

SHEET STORAGE APPARATUS AND IMAGE FORMING APPARATUS

BACKGROUND OF THE INVENTION

Field of the Invention

This disclosure relates to a sheet storage apparatus and an image forming apparatus including the sheet storage apparatus.

Description of the Related Art

There is a widely used image forming apparatus such as a copier, a printer, and a facsimile, which feeds a sheet stored in a sheet storage apparatus to an image forming portion and forms an image. This kind of sheet storage apparatus includes a plate-shaped sheet stacking member on which sheets are stacked, with the sheet stacking member being vertically movable. The sheet stacking member is lowered upon replenishing the sheets. When feeding the sheets, the sheet stacking member is lifted to move the upper surface of the stacked sheet to a position in which the sheet can be fed by a pickup roller located above the sheet stacking member. In addition, the sheet storage apparatus is mounted on an apparatus body in a drawable manner. When storing the sheet, the sheet storage apparatus is drawn out, and then the sheets are set on the sheet stacking member from above.

A sheet storage apparatus disclosed in JP-A-2010-83645 is provided with a trailing end regulating member regulating the upstream ends in a sheet feeding direction (hereinafter, referred to as the trailing ends) of the sheets, which are stacked on a sheet stacking member. The trailing end regulating member is configured to be movable along the sheet feeding direction so that multiple kinds of sheets with different sizes can be stored. In addition, the sheet storage apparatus is provided with side end regulating members which regulate side ends of the sheets in a direction (hereinafter, referred to as a width direction) orthogonal to the sheet feeding direction of the sheets and are movable in the width direction. Then, the side ends of the sheet are regulated by the side end regulating members while the trailing end of the sheet is regulated by the trailing end regulating member, and thereby the position of the sheet is regulated in a predetermined position.

JP-A-04-333429 discloses a configuration that a trailing end regulating plate provided in a sheet feed deck is movable to a regulating position on which the trailing end regulating plate regulates a sheet trailing end and a retracting position on which the trailing end regulating plate is away from the sheet, in accordance with the sheet size. Then, in a case where sheets of a large size are stored, the trailing end regulating plate is tilted down by substantially 90° from a regulating position so as to release the regulating operation of the trailing end, being stored in a lifter plate. This configuration can be used to store the sheets of a large size in a downsized sheet feeding deck.

However, in such a conventional sheet storage apparatus, a thickness of the trailing end regulating member is required to ensure a certain degree of stiffness so as to fulfill a regulating function for the trailing ends of the sheets. Thus, in a case where the trailing end regulating member movable in the sheet feeding direction is used, a length of the sheet storage apparatus in the sheet feeding direction is required to be at least the sum of a length of the maximum size of the sheets to be stored and a thickness of the trailing end regulating member. That is, the sheet storage apparatus with the trailing end regulating member movable in the sheet feeding direction is tend to be long, which leads to enlargement of the sheet storage apparatus.

It is possible to use a trailing end regulating plate that can be stored in the lifter plate so as to prevent enlargement of the sheet storage apparatus. In this case, however, it is required a holding mechanism to hold the trailing end regulating plate, which has been lifted up, in a right angle accurately, thereby leading to increase in cost. Furthermore, since the trailing end regulating plate is tilted and laid down on the sheet feed deck, a thickness of the trailing end regulating plate may negatively affect a sheet storage height, that is, a stacking amount of the sheets.

Here, when using side end regulating members movable in the width direction, the side end regulating members need to be arranged on a downstream side in the sheet feeding direction so as to regulate the side ends of the sheet of the minimum size, of which a length in the sheet feeding direction is the minimum among the sheets to be stored in the sheet storage apparatus. However, when storing sheets having a greater length in the sheet feeding direction than that of the minimum size, the side end regulating members arranged in such a position might not sufficiently regulate the upstream portion, in the sheet feeding direction, of the side ends of the sheets. Thus, there is a case that the side ends on the trailing end portion of the sheet is not sufficiently regulated, and decrease in the stability of sheet feeding operation might occur.

SUMMARY OF THE INVENTION

According to an aspect of this disclosure, a sheet storage apparatus includes a sheet storage portion configured to store a sheet and a regulating member provided in the sheet storage portion. The regulating member includes a regulating portion configured to abut against the sheet stored in the sheet storage portion and is movable to a first regulating position and a second regulating position. In a case where a first sheet having a first size is stored in the sheet storage portion, the regulating member is located on the first regulating position and regulates an end portion in a first direction of the first sheet with the regulating portion. In addition, in a case where a second sheet having a second size different from the first size is stored in the sheet storage portion, the regulating member is located on the second regulating position and regulates an end portion in a second direction orthogonal to the first direction of the second sheet with the regulating portion.

According to another aspect of this disclosure, a sheet storage apparatus includes a sheet storage portion configured to store a sheet and a regulating member provided in the sheet storage portion. The regulating member includes a first regulating portion and a second regulating portion each configured to abut against the sheet stored in the sheet storage portion. The regulating member is movable to a first regulating position and a second regulating position. In a case where a first sheet having a first size is stored in the sheet storage portion, the regulating member is located on the first regulating position and regulates an end portion in a first direction of the first sheet with the first regulating portion. In addition, in a case where a second sheet having a second size different from the first size is stored in the sheet storage portion, the regulating member is located on the second regulating position and regulates an end portion in a second direction orthogonal to the first direction of the second sheet with the second regulating portion.

According to still another aspect of this disclosure, a sheet storage apparatus includes a sheet storage portion configured to store a sheet, a regulating member provided in the sheet storage portion and configured to regulate positions of a sheet stored in the sheet storage portion, and a supporting mechanism configured to support the regulating member to be movable to a first regulating position and a second regulating position. In a case where a first sheet having a first size is stored in the sheet storage portion, the regulating member is located on the first regulating position and regulates an end portion in a first direction of the first sheet. In addition, in a case where a second sheet having a second size different from the first size is stored in the sheet storage portion, the regulating member is located on the second regulating position and regulates an end portion in a second direction orthogonal to the first direction of the second sheet.

Further features of the present invention will become apparent from the following description of exemplary embodiments with reference to the attached drawings. The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Figure 1:
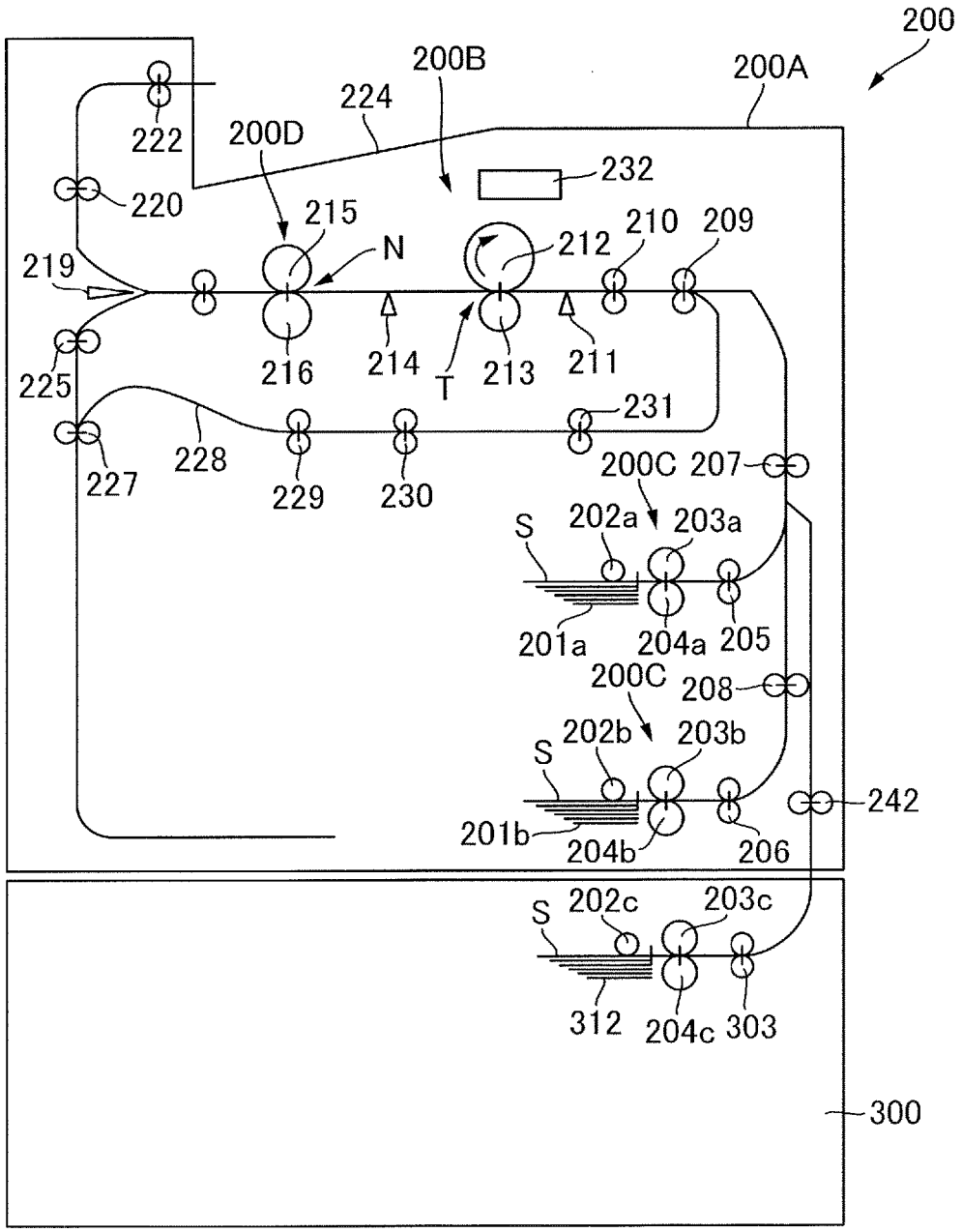
FIG. 1 is a schematic diagram illustrating an image forming apparatus including a sheet storage apparatus according to the first embodiment.

Hereinafter, the first embodiment will be described in detail with reference to the drawings. FIG. 1 is a schematic diagram illustrating an image forming apparatus including a sheet storage apparatus according to the first embodiment.

In FIG. 1, an image forming apparatus 200 includes an image forming apparatus body (hereinafter, referred to as an apparatus body 200A). The apparatus body 200A includes an image forming portion 200B. The apparatus body 200A is provided with a sheet feeding device 200C at a lower portion thereof, which device feeds sheets S (such as recording paper) that are stacked within sheet feeding cassettes 201*a* and 201*b* to the image forming portion 200B. Furthermore, below the apparatus body 200A is provided an option feeder 300, which is an optional sheet feeding device for feeding sheets S that are stacked within a sheet storage 312 to the image forming portion 200B.

The image forming portion 200B includes a photoconductive drum 212 and a laser scanner 232, which is an exposing unit exposing a surface of the photoconductive drum 212 to form an electrostatic latent image on the photoconductive drum 212. In addition, the apparatus body 200A includes a transfer roller 213, which abuts against the photoconductive drum 212 and configures a transfer portion T together with the photoconductive drum 212, and a fixing device 200D, which fixes a toner image transferred by the transfer portion T to the sheet S.

The sheet feeding device 200C includes feed rollers 202*a* and 202*b* for feeding the sheets S stacked in the sheet feeding cassettes 201*a* and 201*b* in order from the uppermost sheet to lower sheets. The sheet feeding device 200C also includes feed rollers 203*a* and 203*b*, and retard rollers 204*a* and 204*b*. Meanwhile, the option feeder 300 includes the sheet storage 312, i.e., a sheet storage apparatus for storing the sheets S, a feed roller 202*c* feeding the sheets S, a feed roller 203*c*, and a retard roller 204*c*.

Next, an image forming operation in the image forming apparatus 200 having such a configuration will be described. In a case where a start switch (not illustrated) is operated, the sheet S is conveyed from the sheet feeding device 200C on the apparatus body or from the option feeder 300. For example, in a case where feeding is performed from the upper sheet feeding cassette 201*a*, a plurality of the sheets S stacked in the sheet feeding cassette 201*a* are fed by the feed roller 202*a*, and then the sheets S are separated one by one by the feed roller 203*a* and the retard roller 204*a*. Thereafter, the sheet S is conveyed to a pre-registration roller pair 209 and a registration roller pair 210 via an upper drawing roller pair 205 and an upper conveyance roller pair 207.

In addition, in a case where feeding is performed from the lower sheet feeding cassette 201*b*, a plurality of the sheets S stacked in the sheet feeding cassette 201*b* are fed by the feed roller 202*b* and then are separated one by one by the feed roller 203*b* and the retard roller 204*b*. Thereafter, the sheet S is conveyed to the pre-registration roller pair 209 and the registration roller pair 210 via a lower drawing roller pair 206, a lower conveyance roller pair 208, and the upper conveyance roller pair 207.

Furthermore, in a case where feeding is performed from the option feeder 300, the sheets S stacked in the sheet storage 312 are fed by the feed roller 202*c* and then are separated one by one by the feed roller 203*c* and the retard roller 204*c*. Then, the sheet S is conveyed to the pre-registration roller pair 209 and the registration roller pair 210 via an option conveyance roller pair 303, an intermediate conveyance roller pair 242, and the upper conveyance roller pair 207.

Here, the sheet S fed from the sheet feeding device 200C and the option feeder 300 may be skewed in conveyance process to the pre-registration roller pair 209 for variation of a conveyance load or component accuracy and for other reason. However, the skew is corrected by the registration roller pair 210 with a registration shutter mechanism (not illustrated). The sheet S, of which skew is corrected, is then detected by a top sensor 211.

When the sheet S is detected by the top sensor 211, a control portion (not illustrated) drives the photoconductive drum 212 to rotate in an arrow direction so that a toner image is transferred to a predetermined position on the sheet S. Then, the surface of the photoconductive drum 212 is charged by a charger (not illustrated), and laser light is applied to the photoconductive drum 212 based on image information from the laser scanner 232. Thus, the electrostatic latent image is formed on the photoconductive drum 212, and thereafter, the electrostatic latent image is developed by a developer (not illustrated) and visualized as a toner image.

The sheet is conveyed to the transfer portion T formed between the transfer roller 213 and the photoconductive drum 212 at a timing when the leading end of the toner image, which is formed on the photoconductive drum 212 through such a process as described above, reaches the transfer portion T. Then, the toner image is transferred onto the sheet S by the transfer roller 213 and a transferred image is formed on the sheet S.

Thereafter, the sheet S with the transferred toner image is conveyed to the fixing device 200D. The toner image is applied heat and pressure when the sheet S passes through a fixing nip portion N between a fixing roller 215 and a pressing roller 216 of the fixing device 200D, so as to be fixed on the sheet. In the present embodiment, when the sheet S is conveyed by both the transfer portion T and the fixing nip portion N, the sheet S is bent so that a difference between sheet conveyance speeds in the transfer portion T and the fixing nip portion N does not affect the transfer of the toner image. According to this purpose, a loop sensor 214 is provided between the transfer portion T and the fixing nip portion N. Then, the control portion (not illustrated) controls a speed of the pressing roller 216 based on a signal of the loop sensor 214 so that a bending amount (displacement) of the sheet S conveyed by the transfer portion T and the fixing nip portion N is regulated within an appropriate range.

When the sheet S on which the toner image is fixed is discharged to an outside of the apparatus body 200A as described above, the control portion switches a duplex switching member 219 and discharges the sheet S on a discharged sheet tray 224 via an intermediate discharging roller pair 220 and a discharging roller pair 222.

Meanwhile, when forming another image on the other side, the sheet S is conveyed to a reverse roller pair 227 by a conveyance roller pair 225 by switching of the duplex switching member 219 and then rotation of the reverse roller pair 227 is reversed.

Thus, the leading and trailing ends of the sheet S are switched, the sheet S is conveyed through a duplex conveying path 228 to the pre-registration roller pair 209 and the registration roller pair 210 by re-conveyance roller pairs 229, 230, and 231. The sheet S is then conveyed to the transfer portion T by the registration roller pair 210 where the toner image is transferred on a back surface (second surface). And then, the sheet S is conveyed to the fixing device 200D so as to fix the toner image. Thereafter, the sheet S is discharged on the discharged sheet tray 224.

Figure 2:
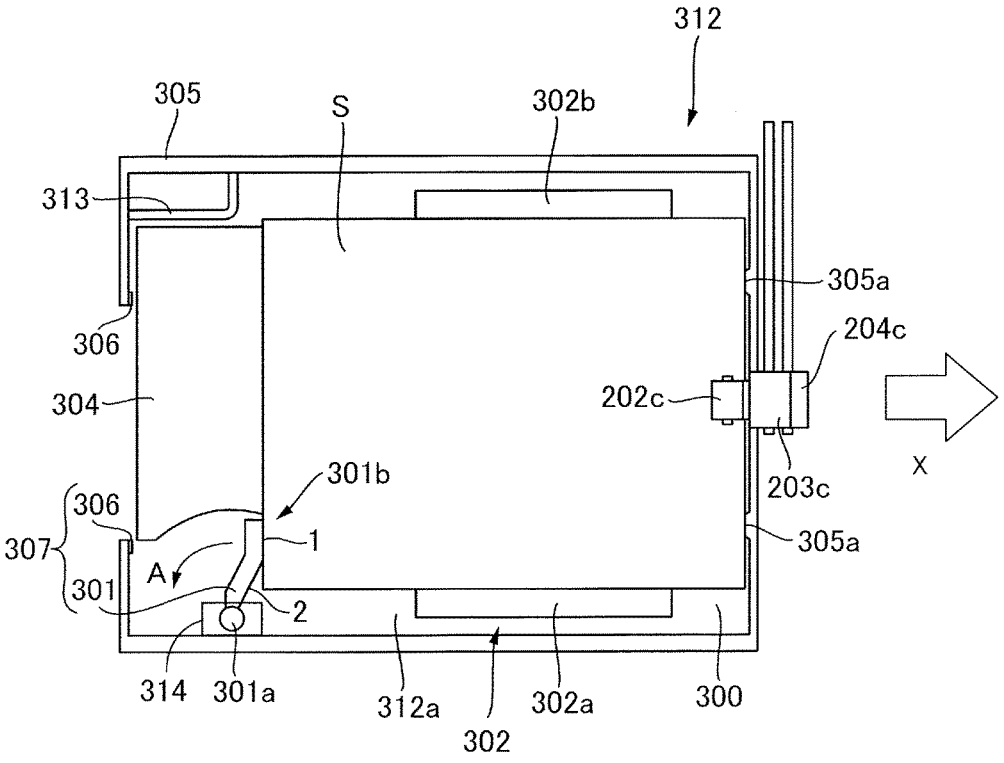
FIG. 2 is a top view of an option feeder including the sheet storage apparatus.

FIG. 2 is a top view of the option feeder illustrating a configuration of the sheet storage 312. As shown in FIG. 2, the sheet storage 312 has a sheet storage portion 312*a* in which multiple kinds of sheets having different sizes can be stored. The sheet storage portion 312*a* includes a frame member 305 forming a sheet storage space. It is noted that the sheet storage portion 312*a* of the present embodiment is configured to store multiple kinds of sheets with different sizes, that is, a sheet of letter size (first sheet) at the minimum, a sheet of legal size (second sheet) at the maximum, and a sheet of A4 size (third sheet) having a long-side length that is intermediate between those of the legal size and the letter size. The letter size, the legal size, and the A4 size are respectively an example of a first size, a second size, and a third size. The sheet storage portion 312*a* may be configured to store sheets of which a long side and a short side are different from those of the above sizes. In addition, although the sheet is stored in a posture in which the long side of the sheet is along a sheet feeding direction in the present embodiment, the sheet may be stored in a posture in which the short side is along the sheet feeding direction. In the following description, the "size" of a sheet refers to a combination of the long-side length and the short-side length of the sheet.

A sheet stacking plate 304, i.e., a sheet stacking member on which sheets are stacked, is provided in the sheet storage portion 312*a* and configured to be moved upward and downward. A pair of side regulating members 302*a* and 302*b* opposed to each other are provided in the sheet storage portion 312*a* and are movable along the width direction. The pair of the side regulating members 302*a* and 302*b* are side end regulating members, which regulate the widthwise position of the sheets S that is stacked on the sheet stacking plate 304. Here, widthwise direction (or the width direction) is a second direction orthogonal to a sheet feeding direction X, which is a first direction. The pair of the side regulating members 302*a* and 302*b* are coupled through an interlocking mechanism (not illustrated) and moves in parallel along the width direction so as to regulate the widthwise position of the sheets.

The regulating member 302*a* on one side is a referential regulating member for defining a reference position in the width direction of the sheet S and the regulating member 302*b* on the other side is a non-referential regulating member including a shifting plate (not illustrated). The regulating member 302*b* on the non-referential side is connected with a biasing mechanism such as a spring for biasing the shifting plate toward the sheet S. Thus, being pressed by the width shifting plate, the sheet S on the sheet stacking plate 304 abuts against the side regulating member 302*a* on the reference side. In this manner the position of the sheet S in the width direction is regulated.

Figure 3:
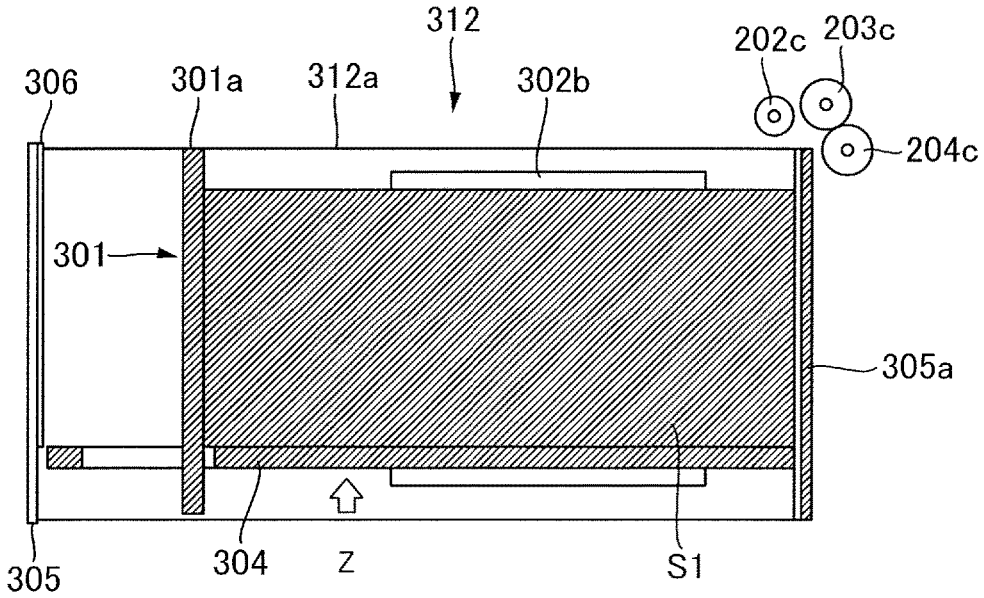
FIG. 3 is a sectional view of the option feeder.

The sheet stacking plate 304 is suspended at four corners by wires (not illustrated) and is vertically moved along a moving direction Z of the sheet stacking plate as illustrated in FIG. 3 by winding or unwinding the wire. When the sheet storage 312 is drawn out for the purpose of stacking the sheets S, the wires are unwound and the sheet stacking plate 304 is lowered to the lowermost position according to a command from the control portion, which detects a drawing operation of the sheet storage 312.

On the other hand, when the sheet storage 312 is closed with sheets S being stacked on the sheet stacking plate 304, the wires are wound and the sheet stacking plate 304 is lifted according to a command of the control portion, which detects a closing operation of the sheet storage 312. Thereafter, the sheet stacking plate 304 is lifted to a predetermined position by the control portion. The control potion lowers or lifts up the sheet stacking plate 304 so as to hold the plate on the predetermined position where the uppermost sheet among the stacked sheets is fed by the feed roller 202*c* and smoothly enter a nip between the feed roller 203*c* and the retard roller 204*c*.

Figure 4A:
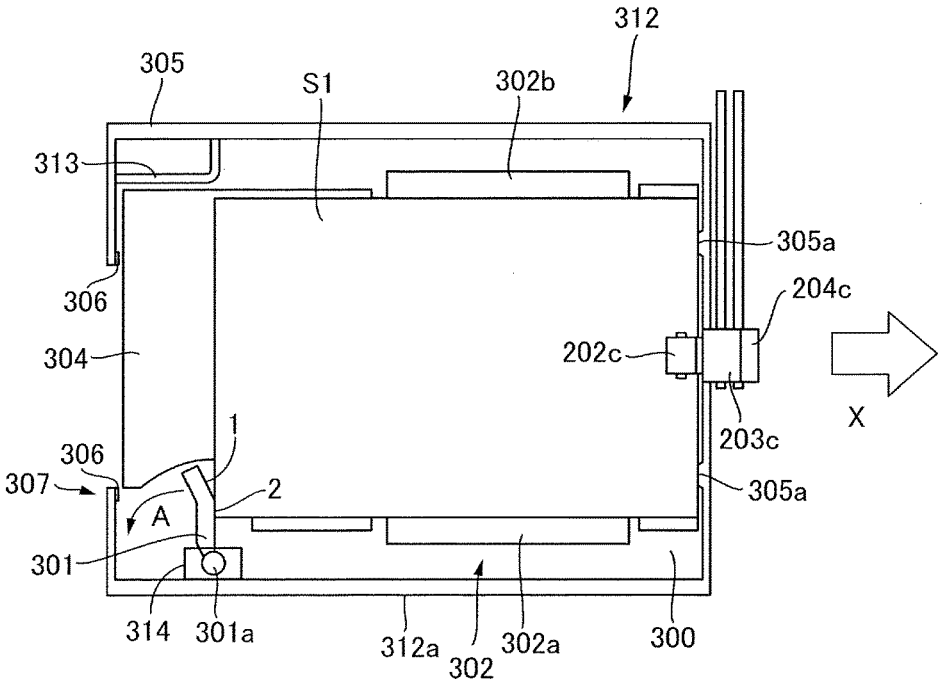
FIG. 4A is a top view of the option feeder storing sheets of A4 size.
Figure 4B:
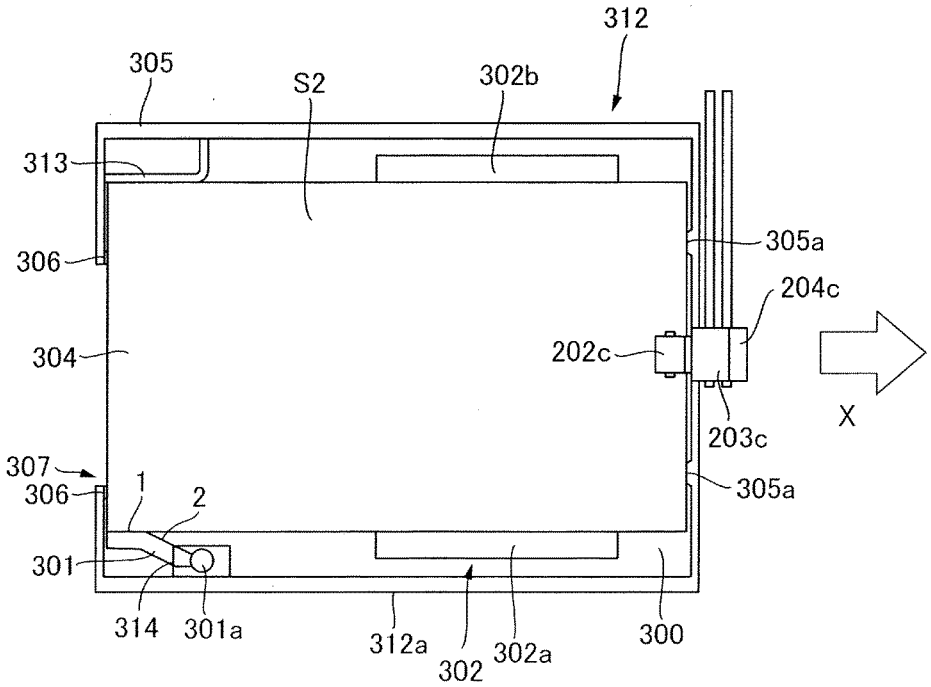
FIG. 4B is a top view of the option feeder storing sheets of legal size.

As illustrated in FIG. 2, a regulating member 301 is provided in the sheet storage 312. The regulating member 301 regulates a trailing end of the sheet S, i.e., an upstream end in the sheet feeding direction, in a case where the sheets S of the letter size (first size) are stored. In addition, as illustrated in FIG. 4A, even in a case where the sheets S1 of the A4 size (third size), which are greater than the letter size are stored, the regulating member 301 regulates the trailing end of the sheet S1. Meanwhile, as illustrated in FIG. 4B, in a case where the sheets S2 of the legal size (second size)

greater than the letter size and the A4 size are stored, the regulating member 301 regulates the side end of the sheet S2.

As illustrated in FIG. 2, a fixed side regulating member 313 is provided in the sheet storage 312. The fixed side regulating member 313 configures a portion of an inner wall of the frame member 305 and is provided on an upstream side of the side regulating member 302*b* in the sheet feeding direction X. As illustrated in FIG. 4B, the fixed side regulating member 313 regulates the side ends of the sheet S2 together with the regulating member 301 in a case where the legal size sheets S2, which is the maximum size of storable sheets, are stored. That is, the fixed side regulating member 313 is an example of a subsidiary regulating portion regulating the upstream part, in the sheet feeding direction, of the widthwise end of the sheet of the third size. In addition, the sheet storage 312 has a rib 306 provided on an inner wall of a rear portion of the frame member 305 and choking portions 305*a* provided on the inner wall of a front portion of the frame member 305.

Here, a distance between the rib 306 and the choking portions 305*a* in the sheet feeding direction X is set in accordance with a length of the long side of the legal size. Thus, as illustrated in FIG. 4B, the positions of the sheets S2 in the sheet feeding direction X are regulated by the rib 306 and the choking portions 305*a* in a case where the legal size sheets S2 are stored in the sheet storage 312. That is to say, in the present embodiment, a trailing end regulating portion 307 (FIG. 2), which regulates the upstream end in the sheet feeding direction of the sheet stored in the sheet storage portion 312*a*, is composed of the rib 306 and the regulating member 301.

Meanwhile, as illustrated in FIG. 2, the regulating member 301 includes a contact portion 301*b* that abuts against the trailing end of the sheet S at a position between the side regulating members 302*a* and 302*b* in the width direction and is configured to regulate the trailing end of the sheet S. The contact portion 301*b* includes a first abutting surface 1, i.e., a regulating portion for regulating the trailing end of the letter size sheets S by abutting against the sheet S. As illustrated in FIG. 4A, the contact portion 301*b* includes a second abutting surface 2 as another regulating portion for regulating the trailing end position of the A4 size sheets S1 by abutting against the sheet S1. The first abutting surface 1 is a first regulating portion and the second abutting surface 2 is a second regulating portion.

The regulating member 301 is a plate member including a shaft 301*a* that is supported by a shaft supporting portion 314, i.e., a supporting mechanism, which is provided on the frame member 305. The shaft 301*a* extends in a vertical direction and supported by the shaft supporting portion such that the regulating member pivots (moves) horizontally. Viewing from an axial direction of the shaft 301*a*, the second abutting surface 2 extends in a radial direction from the shaft supporting portion 314 when. On the other hand, the first abutting surface 1 is formed to be bent from a connection portion with the second abutting surface 2. The first abutting surface is inclined upstream in the sheet feeding direction in a state where the second abutting surface 2 is perpendicular to the sheet feeding direction (see FIG. 4A).

With such a configuration, the regulating member 301 is moved through a pivotal operation to the regulating positions in accordance with the size of the sheet stored in the sheet storage portion 312*a*. That is, in a case where the letter size sheets S (first size) are stored in the sheet storage portion 312*a*, the regulating member 301 is moved to the first regulating position illustrated in FIG. 2. In a case where the A4 size (third size) sheets S1 are stored in the sheet storage portion 312*a*, the regulating member 301 is moved to the third regulating position illustrated in FIG. 4A. Then, in a case where the legal size (second size) sheets S2 are stored in the sheet storage portion 312*a*, the regulating member 301 is moved to the second regulating position illustrated in FIG. 4B.

The first regulating position and the third regulating position are trailing-end regulating positions on which the regulating member 301 regulates the trailing end of the sheet, and the second regulating position is a side-end regulating position on which the regulating member 301 regulates the side end of the sheet. In the present embodiment, an operation angle between the first regulating position and the second regulating position is 90 degrees and the third regulating position is located between them. The third regulating position is a position, in particular, on which the regulating member 301 is pivotally operated from the first regulating position by the magnitude of the angle formed by the first abutting surface 1 and the second abutting surface 2.

Then, for example, in a case where the A4 size sheets S1 instead of the letter size illustrated in FIG. 2 are stored, the regulating member 301 located in the first regulating position is pivoted in an arrow direction about the shaft 301*a*. Thus, the regulating member 301 moves to the third regulating position (FIG. 4A) on which the second abutting surface 2 comes to be along the width direction of the sheet and the trailing end of the sheet S1 is regulated by the second abutting surface 2. It is noted that the movement of the A4 size sheets S1 is restricted by fixing the regulating member 301 by a fixing device (not illustrated) after pivoting the regulating member 301 as described above.

Here, the capability of the side regulating members 302 (302*a* and 302*b*) for regulating the side ends of the sheets increases as the side regulating members 302 are lengthened in the sheet feeding direction X. Meanwhile, a cut-out portion is formed in the sheet stacking plate 304 in order to avoid interfering with the side regulating members 302 when the sheet stacking plate 304 is lifted. However, the side regulating members 302 having a large length in the sheet feeding direction X necessitates a large cut-out. This might, however, decrease the strength of the sheet stacking plate 304.

Thus, the lengths of the side regulating members 302 are set to a suitable value in consideration of the stiffness of the sheet stacking plate 304, the cost and regulation capability of the side regulating members 302, and the like. In addition, it is preferable that the side regulating members 302 are disposed closer to the downstream side of the sheet storage 312 in the sheet feeding direction X so as to regulate the side ends of the sheet even in a case where sheets with a relatively small length in the sheet feeding direction is stored. Thus, the side regulating members 302 are disposed so as to abut against a substantially center portion in the sheet feeding direction X of the sheet S and S1 of the letter/A4 size.

With the side regulating member 302*a* configured as described above, the side ends of the sheets S and S1 of the letter/A4 size to be fed are reliably regulated along the side regulating member 302*a* on the referential side, thereby setting failure of the sheets being avoided. In addition to avoiding failure in sheet setting, printing accuracy is kept at high level for keeping image quality by regulating the trailing end of the sheets with the regulating member 301.

By the way, since the side regulating members 302 are disposed on such a position, the side regulating members 302 does not directly regulate the side end of the trailing part (upstream part in the sheet feeding direction) in the legal size sheets S2. Thus, in such a case that an user has set carelessly the legal size sheets S2, set positions of the trailing part of the sheets S2 might be disordered. If the sheet S2 in such a state is fed, printing accuracy might be deteriorated. In addition, when the sheet S2 is fed, skew of the sheet S2 may occur due to component accuracy and durability wear of the feed roller 202*c*, and the like. In particular, in a case where the feed roller 202*c* is supported on a cantilever shaft, an abutting pressure of the feed roller 202*c* against the sheet S2 tends to be uneven and skew may occur in the sheet S2 when feeding the sheet S2.

However, in the present embodiment, the regulating member 301 is turned around the shaft 301*a* from the third regulating position (an intermediate regulating position) illustrated in FIG. 4A in the direction A in a case where the legal size sheets S2 are stacked on the sheet stacking plate 304, as described above. Thus, as illustrated in FIG. 4B, the regulating member 301 moves to the side-end regulating position and comes to regulate the trailing part of the sheet S2 in the width direction with the first abutting surface 1. It is noted that, within a moving range of the regulating member 301, the regulating member 301 can be fixed on an arbitrary position including the first regulating position, the second regulating position, and the third regulating position.

Thus, the trailing-end part of the sheet S2 is regulated in the width direction by the regulating member 301 and the fixed side regulating member 313 facing to the regulating member 301. That is, in the present embodiment, the position of the sheet S2 in the width direction is regulated by the regulating member 301 and the fixed side regulating member 313 in addition to the side regulating members 302. Such a configuration enables the apparatus to improve printing accuracy.

Here, in the present embodiment, the position of the sheet S2 in the sheet feeding direction X is regulated by the rib 306 and the choking portions 305*a* in a case where the legal size sheets S2 are stored. That is, the trailing end of the legal size sheets S2 is regulated by the rib 306 fixed on the sheet storage 312. Such a configuration, in which the trailing end of the sheet S2 is regulated by the fixed rib 306, eliminates the need for the conventional trailing end regulating member.

As described above, in the present embodiment, the side ends of the sheets S and S1 are regulated by the side regulating members 302 and the trailing ends of the sheets S and S1 are regulated by the regulating member 301 when storing the sheets S and S1 of the letter size and the A4 size. Meanwhile, when storing the legal size sheets S2, the regulating member 301 retreats in the width direction and the widthwise position of the sheet S2 is regulated by the retreated regulating member 301 and the fixed side regulating member 313 in addition to the side regulating members 302. Besides, regulation of the trailing end of the legal size sheets S2 is performed by the rib 306 provided on the frame member 305.

In short, the regulating member 301 is configured to move to the first regulating position on which the first abutting surface 1 regulates the trailing end of the letter size sheet S (first sheet) and the second regulating position on which the first abutting surface 1 regulates the side end of the legal size sheet S2 (second sheet). With this configuration, the trailing end of the sheet S2 is regulated without using the conventional trailing end regulating member, which improves stability of sheet feeding operation.

Moreover, such a configuration not using the conventional trailing end regulating member enables to reduce the length of the option feeder 300 in the sheet feeding direction X by a width of the trailing end regulating member and to reduce the size of the option feeder 300. In addition, setting failure due to forgetting the setting of the trailing end regulating member is avoided. Furthermore, a simple operation of pivoting the regulating member 301 prevents deterioration of printing accuracy, which is due to setting failure of the sheets of the legal size that are carelessly set by the user, and the occurrence of skew, which is due to component accuracy and the like.

It is noted that, although the regulating member 301 is pivoted around the shaft 301*a* in the above description, the support configuration of the regulating member 301 is not limited to that. For example, the frame member 305 may be provided with insertion holes that are disposed corresponding to the trailing end of the letter/A4 size sheets and configured to fit with the regulating member. In this case, the regulating member 301 is located at trailing-end regulating positions by inserting the regulating member 301 into the insertion holes. The frame member 305 may be provided with another insertion hole that is disposed corresponding to the side end of the legal size sheets and configured to fit with the regulating member. In this case, the regulating member 301 is located at side-end regulating positions by inserting the regulating member 301 into the insertion hole.

Figure 5:
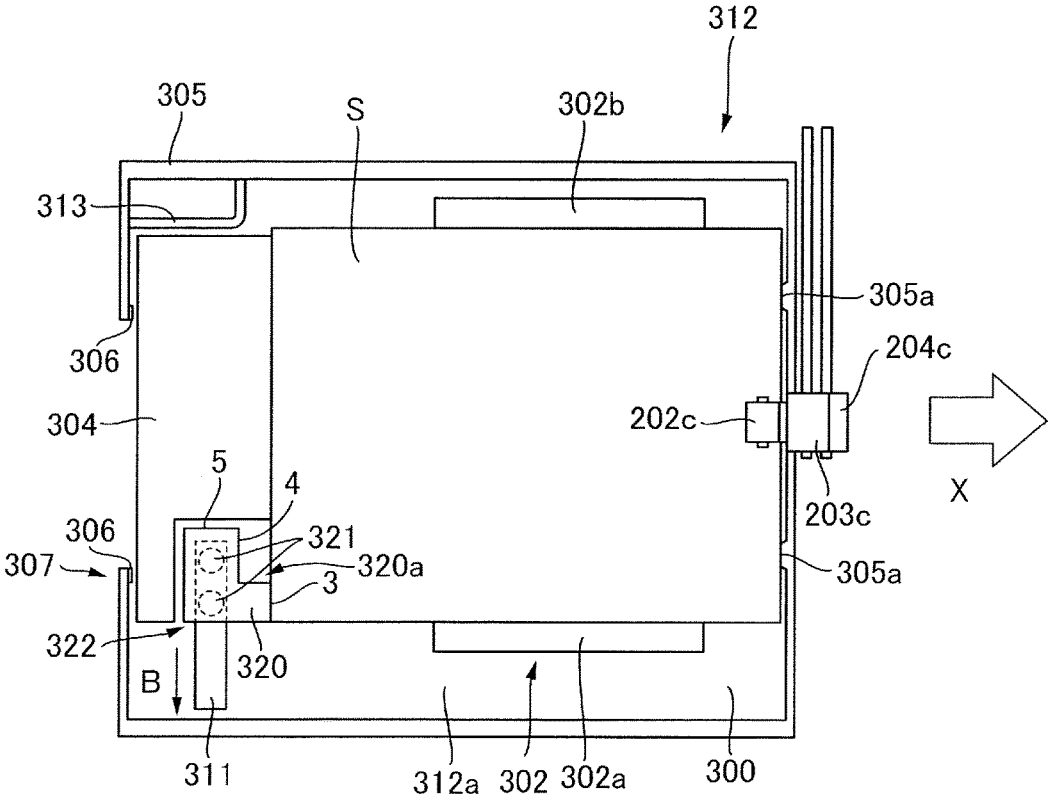
FIG. 5 is a top view of an option feeder including a sheet storage apparatus according to the second embodiment.

Now, the second embodiment will be described. FIG. 5 is a top view of an option feeder 300 including a sheet storage apparatus according to the second embodiment. Here, the same reference numerals in FIG. 5 as those in FIG. 4 indicate the same or corresponding portions described above.

Figure 6A:
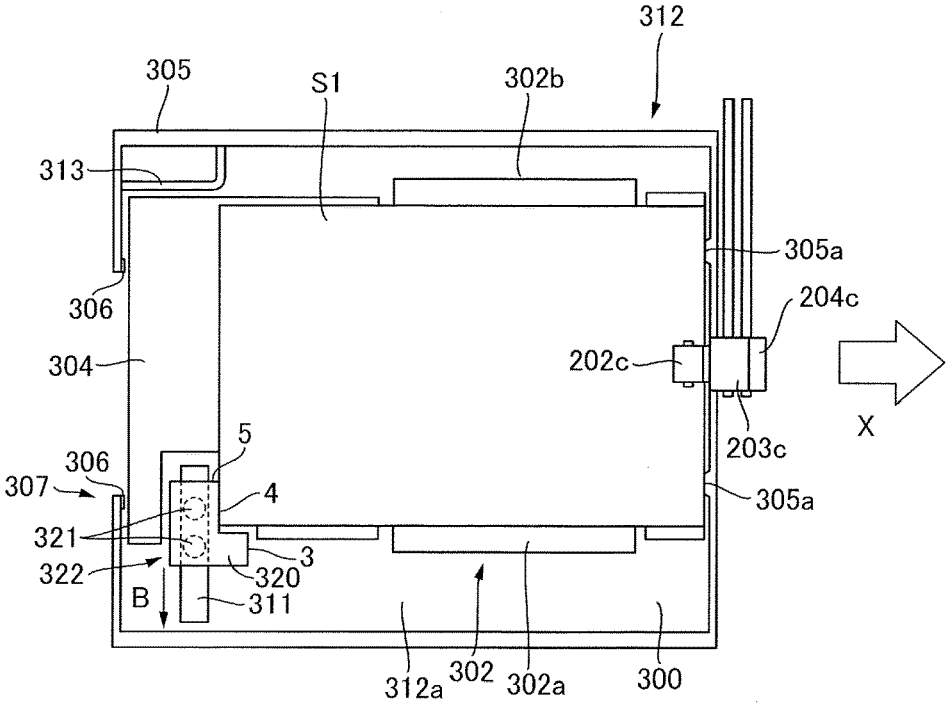
FIG. 6A is a top view of the option feeder storing sheets of A4 size.
Figure 6B:
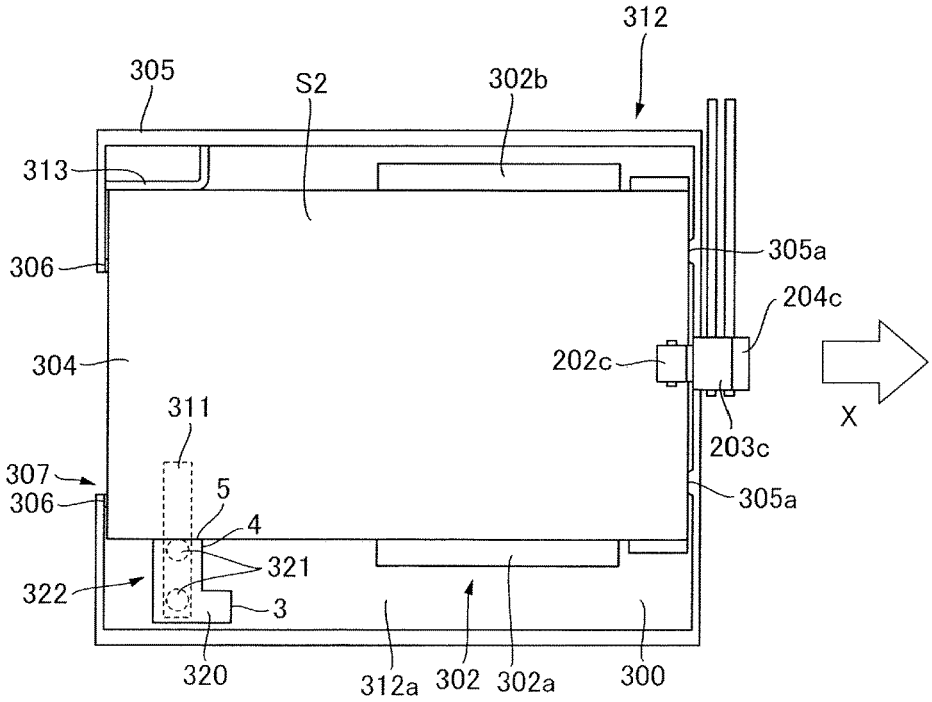
FIG. 6B is a top view of the option feeder storing sheets of legal size.

As illustrated in FIG. 5, a regulating member 320 is provided in sheet storage 312 and the regulating member 320 includes a trailing end contact portion 320*a* which abuts against trailing end of sheets S to regulate the trailing end position. The trailing end contact portion 320*a* includes a first trailing-end abutting surface 3, i.e., a first regulating portion for regulating the trailing end position of the sheet S by abutting the trailing end of the sheet. As illustrated in FIG. 6A, the trailing end contact portion 320*a* includes a second trailing-end abutting surface 4, i.e., a third regulating portion for regulating the trailing end position of the A4 size sheets S1 by abutting the trailing end of the sheet. In addition, as illustrated in FIG. 6B, the regulating member 320 includes a side end abutting surface 5, i.e., a second regulating portion which is formed parallel to a sheet feeding direction X and configured to regulate the side end position of the sheet S2 in a case where the legal size sheets S2 are stored.

The first trailing-end abutting surface 3 and the second trailing-end abutting surface 4 are formed in parallel to each other and substantially perpendicular to the sheet feeding direction X. The side end abutting surface 5 is formed to be perpendicular to the width direction. Since the first trailing-end abutting surface 3 is disposed on the downstream sides in the sheet feeding direction X and on the outside in the width direction with respect to the second trailing-end abutting surface 4, the regulating member 320 has a stepped shape.

In addition, in FIG. 5, bosses 321 and 321, each arranged in the width direction, are provided respectively on an upper surface and a lower surface of the regulating member 320. Long holes 311 are formed on a supporting portion (not illustrated) provided on a bottom of the sheet storage portion 312*a* and on the frame member 305. The boss 321 is fit into the long holes so as to allow the regulating member 320 to slide. Then, in the present embodiment, a supporting mechanism 322, which supports the regulating member 320 to be movable (slidable) in the width direction, is configured by the boss 321 and the long holes 311. Thus, the regulating member 320 is moved to a first regulating position illustrated in FIG. 5 on which the trailing end of the letter size sheets S is regulated and a second regulating position illustrated in FIG. 6B on which the side end of the legal size sheets S2 is regulated. In addition, the regulating member 320 is moved to a third regulating position (FIG. 6A), located between the first regulating position and the second regulating position in the width direction, on which the trailing end of the A4 size sheets S1 is regulated.

Then, for example, in a case where the A4 size sheets S1 are stored instead of the letter size sheets S illustrated in FIG. 5, the regulating member 320 is slided toward the outside (direction B) in the width direction using the supporting mechanism 322. Thus, the regulating member 320 located at the first regulating position, on which the trailing end of the letter size sheets S is regulated, is moved to the third regulating position on which the second trailing-end abutting surface 4 regulates the trailing end of the sheet S1 of the A4 size. It is noted that, after the regulating member 301 pivoting as described above, the movement of the A4 size sheets S1 is restricted by fixing the regulating member 320 with a fixing device (not illustrated).

Furthermore, in a case where the legal size sheets S2 are stacked on a sheet stacking plate 304, the regulating member 320 is further slided from the position illustrated in FIG. 6A in the direction B. Thus, as illustrated in FIG. 6B, the regulating member 320 is moved to the second regulating position in which the position of the trailing end portion of the legal size sheets S2 in the width direction is regulated by the side end abutting surface 5. Then, after such a movement, the regulating member 320 is fixed by the fixing device (not illustrated).

Here, as described above, similar to the first embodiment described above, the regulating member 320 is slided to the side end regulating position, thereby regulating the position of the legal size sheets S2 in the width direction by the regulating member 320 and the fixed side regulating member 313. In addition, it is possible to perform regulation of the trailing end position of the legal size sheets S2 by the rib 306 provided in the frame member 305.

As described above, in the present embodiment, the regulating member 320 is moved using the supporting mechanism 322 to the first regulating position on which the trailing end of the letter size sheet is regulated by the trailing-end abutting surface 3. In addition, the regulating member 320 is moved to the third regulating position on which the trailing end of the sheet of the A4 size is regulated by the trailing-end abutting surface 4 and the second regulating position on which the legal size sheets S2 in the width direction is regulated by the side end abutting surface 5.

That is, in the present embodiment, the trailing end positions of the letter size sheets S and the A4 size sheets S1 are regulated by the regulating member 320. In addition, the position of the legal size sheets S2 in the width direction is regulated by the regulating member 301 moved (retreated) in the width direction and the fixed side regulating member 313. Besides, regulation of the trailing end of the legal size sheets S2 is performed by the rib 306 provided on the frame member 305.

Thus, it is possible to obtain the same effects as the first embodiment described above. In addition, with such a configuration as described in the present embodiment, it is easy to ensure a length of the side end abutting surface 5 in the sheet feeding direction X for preventing setting failure of the legal size sheets and skew of the sheet during sheet feeding more efficiently. By the way, although the supporting mechanism 322 slidably supporting the regulating member 320 is configured with the boss 321 and the long hole 311 provided in the regulating member 320 in the present embodiment, other mechanisms such as a rack mechanism, a belt mechanism, and a ball screw mechanism may be used in accordance with required operability.

Figure 7:
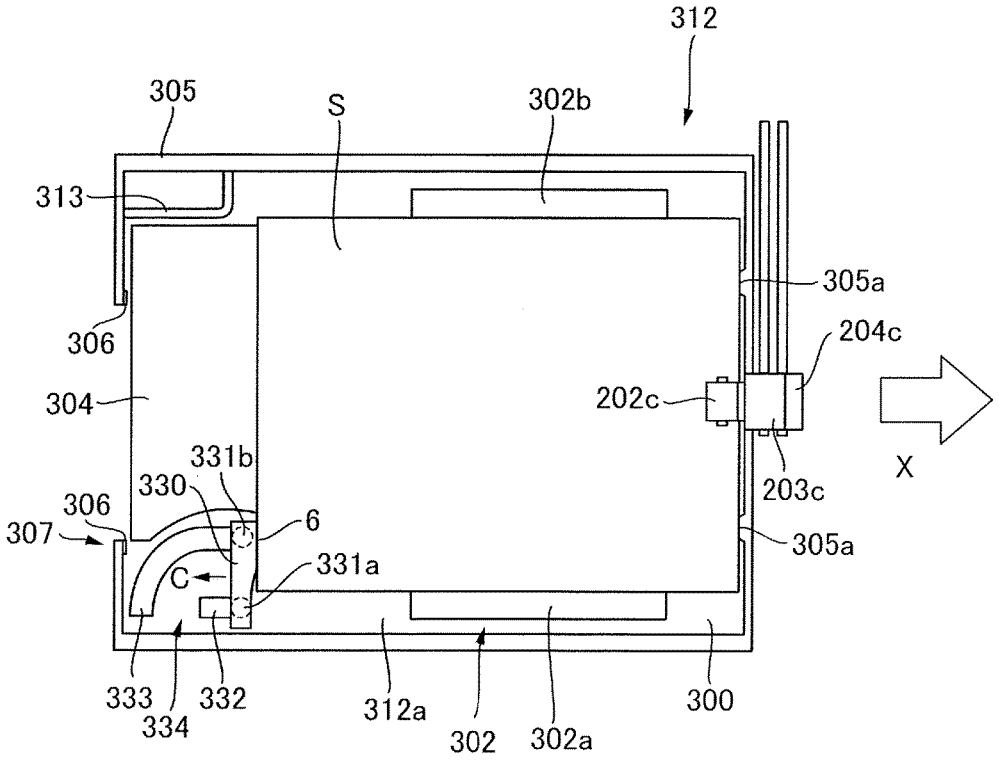
FIG. 7 is a top view of an option feeder including a sheet storage apparatus according to the third embodiment.

Next, a third embodiment of this disclosure will be described. FIG. 7 is a top view of an option feeder 300 including a sheet storage apparatus according to the third embodiment. It is noted that, in FIG. 7, the same reference numerals as those in FIG. 5 described above indicate the same or corresponding portions.

Figure 8A:
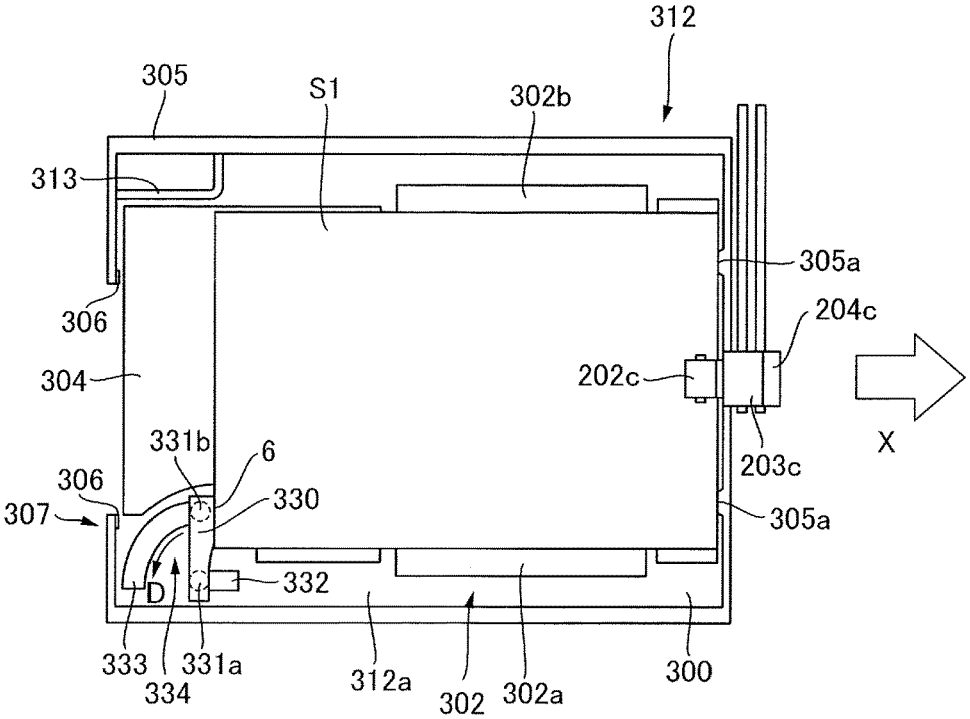
FIG. 8A is a top view of the option feeder storing sheets of A4 size.
Figure 8B:
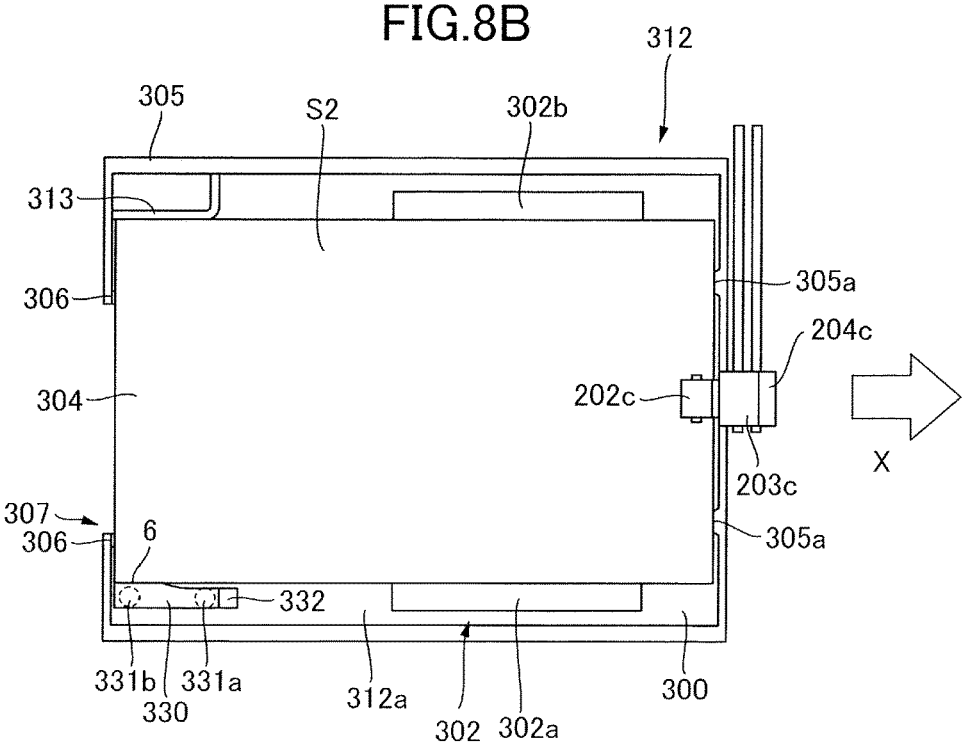
FIG. 8B is a top view of the option feeder storing sheets of the legal size.

In FIG. 7, a sheet storage 312 includes a regulating member 330. The regulating member 330 includes an abutting surface 6, i.e., a regulating portion that regulates the trailing end and the side end of the sheet. The abutting surface 6 regulates the trailing end position by abutting against the trailing end of the sheet in a case where the letter size sheets S and the A4 size sheets S1 (see FIG. 8A) are stored in the sheet storage 312. As illustrated in FIG. 8B, in a case where the legal size sheets S2 are stored, the regulating member 330 regulates the side end position of the sheet with the abutting surface 6 abutting against the side end of the sheet S2.

In addition, in FIG. 7, bosses 331*a* and 331*b* are provided in each of the upper surface and a lower surface of the regulating member 330. Long holes 332 are formed on a supporting portion (not illustrated) provided on a bottom of the sheet storage portion 312*a* and on the frame member 305. One boss 331*a* is fit into the long holes so as to allow the regulating member 320 to slide along the sheet feeding direction X. In addition, on the supporting portion provided on the bottom of the sheet storage portion 312*a* and on the frame member 305 is formed an arc-shaped guide hole 333, which fits with the other boss 331*b* and allows the regulating member 330 to pivot.

A portion of the guide hole 333 on the downstream side in the sheet feeding direction is parallel to the long hole 332 and a curved portion is formed continuously to the parallel portion. In the present embodiment, a supporting mechanism 334 supporting the regulating member 330 to be movable is configured of the guide hole 333, the bosses 331*a* and 331*b*, and the long hole 332. Thus, the regulating member 330 is slided between a first regulating position (FIG. 7) on which the trailing end of the letter size sheets S is regulated and a third regulating position (FIG. 8A) on which the trailing end of the A4 size sheets S1 is regulated. In addition, the regulating member 330 is configured to pivot between the third regulating position and a second regulating position (FIG. 7B), on which the side end of the legal size sheets S2 is regulated. That is, the long hole 332 is a guide portion that turnably supports the boss 331*a*, which is a pivotal shaft about which the regulating member 330 pivots, and guides movement of the boss 331*a* in the sheet feeding direction X.

Then, in a case where the A4 size sheets S1 are stored instead of the letter size sheets S illustrated in FIG. 7, for example, the regulating member 330 is slided in a direction C by moving the bosses 331*a* and 331*b* along the long hole 332 and a portion of the guide hole 333 parallel to the long hole 332. Thus, as illustrated in FIG. 8A, the regulating member 330 that is located at the first regulating position is moved to the third regulating position on which the trailing end of the A4 size sheets S1 is regulated by the abutting surface 6. It is noted that, after moving the regulating member 330 as described above, the movement of the A4 size sheets S1 is restricted by fixing the regulating member 330 using a fixing device (not illustrated).

Furthermore, in a case where the legal size sheets S2 are stacked on the sheet stacking plate 304, the regulating member 330 is turned about the boss 331*a* from the third regulating position illustrated in FIG. 8A, by moving the boss 331*b* along the guide hole 333 in a direction D. Thus, as illustrated in FIG. 8B, the regulating member 330 is moved to the second regulating position on which the trailing end part of the legal size sheets S2 is regulated in the width direction by the abutting surface 6. Then, after moving as described above, the regulating member 330 capable of pivoting is fixed using the fixing device.

Here, similar to the first embodiment described above, it is possible to regulate the position of the legal size sheets S2 in the width direction by the regulating member 330 and a fixed side regulating member 313, by pivotally moving the regulating member 330 to the second regulating position. In addition, it is possible to perform regulation of the trailing end position of the legal size sheets S2 by the rib 306 provided in the frame member 305.

As described above, in the present embodiment, the regulating member 330 is slided to the position in which the trailing end of the letter size sheets S and the A4 size sheets S1 are regulated by the abutting surface 6 by the supporting mechanism 334. In addition, the regulating member 330 is pivotally moved from the position in which the trailing end of the A4 size sheets S1 is regulated to the position in which the legal size sheets S2 is regulated in the width direction by the abutting surface 6.

With this configuration, the present embodiment obtain similar effects as the first embodiment. In addition, in the present embodiment, since the single abutting surface 6 is capable of regulating both the trailing end and the side end (widthwise end) of the sheet, it is not necessary to provide a plurality of contact surfaces, each of which requires fine smoothness, and it is possible to design the regulating member 330 at a low cost.

It is noted that, a lock mechanism including, for example, locking teeth for locking the regulating member 330 may be provided along a sliding range of the regulating member 330. In that case, the regulating member 330 can be fixed on a desired position, which may ease the constraint on size variation of the sheet whose trailing end is regulated. It is noted that, also in the present embodiment, the boss 331 provided in the regulating member 330 and two long holes 332 and 333 guiding the boss 331 of the regulating member 330 are used, but a unit that slides and pivotally moves the regulating member 330 is not limited to the present embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-070665, filed on Mar. 31, 2015, which is hereby incorporated by reference herein in its entirety.

What is claimed is:

1. A sheet storage apparatus comprising:

a sheet storage portion configured to store a sheet; and a regulating member provided movably in the sheet storage portion and comprising a first regulating surface configured to abut against a sheet stored in the sheet storage portion and a second regulating surface configured to abut against a sheet stored in the sheet storage portion, the regulating member being movable to (i) a first regulating position on which the first regulating surface is orthogonal to a first direction, and abuts against and regulates end portions, in the first direction, of a plurality of first sheets each having a first size in a case where the plurality of first sheets are stored in the sheet storage portion, (ii) a second regulating position on which the first regulating surface is parallel with the first direction, and abuts against and regulates end portions, in a second direction orthogonal to the first direction, of a plurality of second sheets each having a second size different from the first size in a case where the plurality of second sheets are stored in the sheet storage portion, and (iii) a third regulating position on which the second regulating surface is orthogonal to the first direction and regulates end portions in the first direction, of a plurality of third sheets each having a third size, the third sheet having a different length in the first direction from the first sheet and the second sheet.

2. The sheet storage apparatus according to claim 1, further comprising a supporting mechanism configured to support the regulating member such that the regulating member pivots between the first regulating position and the second regulating position.

3. The sheet storage apparatus according to claim 1, wherein the first direction is one of a sheet feeding direction in which a sheet stored in the sheet storage portion is conveyed out of the sheet storage portion and a sheet width direction orthogonal to the sheet feeding direction, and the second direction is the other of the sheet feeding direction and the sheet width direction.

4. The sheet storage apparatus according to claim 1, wherein the third regulating position is located between the first regulating position and the second regulating position in a moving range of the regulating member.

5. The sheet storage apparatus according to claim 1, further comprising a supporting mechanism configured to support the regulating member such that the regulating member pivots to the first regulating position, the second regulating position, and the third regulating position, wherein the regulating member comprises a plate member that is bent to form the first regulating surface and the second regulating surface inclined with respect to the first regulating surface.

6. The sheet storage apparatus according to claim 1, wherein a length in the first direction of the third sheet is greater than a length in the first direction of the first sheet and less than a length in the first direction of the second sheet.

7. The sheet storage apparatus according to claim 1, wherein the first direction is a sheet feeding direction in which a sheet stored in the sheet storage portion is conveyed out of the sheet storage portion, and the regulating member is moved from the first regulating position to the second regulating position by pivoting upstream of the sheet feeding direction.

8. The sheet storage apparatus according to claim 1, further comprising a supporting mechanism configured to support the regulating member, wherein the supporting mechanism supports the regulating member such that the regulating member moves in parallel with the first direction between the first and third regulating positions, in a state in which the first regulating surface is orthogonal to the first direction, and pivots between the second and third regulating positions.

9. The sheet storage apparatus according to claim 8, wherein the supporting mechanism comprises a guide portion pivotally supporting a pivotal shaft of the regulating member and guiding a movement of the pivotal shaft in parallel with the first direction upon moving the regulating member between the first regulating position and the third regulating position.

10. The sheet storage apparatus according to claim 8, wherein the third regulating position is located between the first regulating position and the second regulating position in a moving range of the regulating member.

11. The sheet storage apparatus according to claim 1, further comprising a subsidiary regulating portion provided to face the regulating member in the second direction, the subsidiary regulating portion configured to regulate another end portion in the second direction of the second sheet in parallel with the regulating member positioned on the second regulating position.

12. The sheet storage apparatus according to claim 1, wherein the first direction is a sheet feeding direction in which a sheet stored in the sheet storage portion is conveyed out of the sheet storage portion, and the end portion in the first direction of the sheet is an upstream end in the sheet feeding direction.

13. An image forming apparatus comprising:

an image forming portion configured to form an image on a sheet; and the sheet storage apparatus according to claim 1 storing sheets to be fed to the image forming portion.

14. The sheet storage apparatus according to claim 1, wherein the regulating member is moved from the first regulating position to the second regulating position by pivoting by 90 degrees, and the third regulating position is an intermediate angle between the first regulating position and the second regulating position, and the second regulating surface is inclined with respect to the first regulating surface such that the second regulating surface is orthogonal to the first direction at the third regulating position.

15. A sheet storage apparatus comprising:

a sheet storage portion configured to store a sheet; and a regulating member provided movably in the sheet storage portion and comprising a first regulating surface and a second regulating surface, the regulating member being movable to (i) a first regulating position on which the first regulating surface abuts against and regulates end portions, in a first direction, of a plurality of first sheets each having a first size in a case where the plurality of first sheets are stored in the sheet storage portion, and (ii) a second regulating position on which the second regulating surface abuts against and regulates end portions, in a second direction orthogonal to the first direction, of a plurality of second sheets each having a second size different from the first size in a case where the plurality of second sheets are stored in the sheet storage portion, wherein the regulating member is configured to move in parallel with the second direction to the first regulating position and the second regulating position in a state in which the first regulating surface is orthogonal to the first direction and the second regulating surface is orthogonal to the second direction, wherein the first direction is one of a sheet feeding direction in which a sheet stored in the sheet storage portion is conveyed out of the sheet storage portion and a sheet width direction orthogonal to the sheet feeding direction, and the second direction is the other of the sheet feeding direction and the sheet width direction.

16. The sheet storage apparatus according to claim 15, wherein the regulating member further comprises a third regulating surface configured to abut against an end portion, in the first direction, of a third sheet having a third size, the third size being different from the first size and the second size, and wherein the regulating member is movable to a third regulating position on which the third regulating surface abuts against and regulates end portions in the first direction, of a plurality of third sheets each having a third size.

17. The sheet storage apparatus according to claim 16, further comprising a supporting mechanism configured to support the regulating member such that the regulating member moves in parallel with the second direction to the first regulating position, the second regulating position, and the third regulating position.

18. The sheet storage apparatus according to claim 16, wherein the third regulating position is located between the first regulating position and the second regulating position in a moving range of the regulating member.

19. The sheet storage apparatus according to claim 16, wherein the first regulating surface and the third regulating surface are disposed in parallel along the second direction and are formed into a stepped shape.

20. The sheet storage apparatus according to claim 16, wherein a length in the first direction of the third sheet is greater than a length in the first direction of the first sheet and less than a length in the first direction of the second sheet.

* * * * *